US008731227B2

(12) United States Patent
Hwang

(10) Patent No.: US 8,731,227 B2
(45) Date of Patent: May 20, 2014

(54) TILTABLE EARPHONE

(75) Inventor: Soon Ahn Hwang, Uiwang-Si (KR)

(73) Assignee: Feel's Electronics Co., Ltd., Uiwang-si, Gyeonggi-do (KR)

( * ) Notice: Subject to any disclaimer, the term of this patent is extended or adjusted under 35 U.S.C. 154(b) by 0 days.

(21) Appl. No.: 13/349,409

(22) Filed: Jan. 12, 2012

(65) Prior Publication Data

US 2012/0177240 A1 Jul. 12, 2012

(30) Foreign Application Priority Data

Jan. 12, 2011 (KR) ..... 10-2011-0002923

(51) Int. Cl.
*H04R 1/10* (2006.01)

(52) U.S. Cl.
USPC ..... 381/379; 381/328; 381/380; 181/135

(58) Field of Classification Search
USPC ..... 381/379, 374, 380; 181/130, 135
See application file for complete search history.

(56) References Cited

U.S. PATENT DOCUMENTS

| | | | | |
|---|---|---|---|---|
| 6,205,227 | B1 * | 3/2001 | Mahoney et al. | 381/328 |
| 8,116,501 | B2 * | 2/2012 | Kusuda et al. | 381/380 |
| 8,213,663 | B2 * | 7/2012 | Koo | 381/371 |
| 2008/0152163 | A1 | 6/2008 | Mulvey | |

FOREIGN PATENT DOCUMENTS

| | | | |
|---|---|---|---|
| KR | 10-2006-0097686 | A | 9/2006 |
| KR | 10-2010-0055579 | A | 5/2010 |

* cited by examiner

*Primary Examiner* — Davetta W Goins
*Assistant Examiner* — Oyesola C Ojo
(74) *Attorney, Agent, or Firm* — Juan Carlos A. Marquez; Morris, Manning & Martin LLP

(57) ABSTRACT

An earphone has an ear cushion mounted thereon to be freely tiltable. The body includes an outer case enclosing a sound wave generating means, and a ball joint provided at an end portion of the outer case that has a sound wave path that propagates sound waves out of the body and having an opening communicating with the sound wave path. An operation holder mounted on the outer circumference of the ball joint includes a frictional ball seat whose inner surface contacts with the outer circumference of the ball joint so as to combine an internal passage communicating with the inner space of the frictional ball seat, and a periphery for the ear cushion. Thus, the earphone becomes sturdier because the body and its outer portion are not structurally weakened. Productivity improves by process simplification. The assembly of the sliding portion is done only on the outside of the body.

3 Claims, 4 Drawing Sheets

20
10
Vibration
Vibration
BODY
24
40
60
Tilting

TILTABLE EARPHONE

RELATED APPLICATIONS

This application claims priority from Korean Patent Application No. 10-2011-0002923, filed on Jan. 12, 2011 in the Korean Intellectual Property Office, the entire disclosure of which is incorporated herein by reference.

BACKGROUND OF THE INVENTION

1. Field of the Invention

The present invention relates to a tiltable earphone, and more specifically to an earphone in which the ear cushion mounted on the earphone body can be tilted freely with respect to the body.

2. Description of the Related Art

In general, an earphone is used with being inserted into the external auditory canal of the ear. At this time, in order to alleviate the pain of the external auditory canal and improve insertion maintainability, ear cushions are usually mounted on the earphone body.

The earphone body includes an outer case, which encloses and supports the sound wave generating means such as a speaker while shutting it off from an external space, and a sound wave path, which guides toward the external auditory canal a sound wave generated from the sound wave generating means. And an ear cushion is mounted on the end portion of the sound wave path.

In general, an angle made by the center line of the body and the center line of the ear cushion, namely, a tilting angle, becomes a very important element when inserting the ear cushion first into the external auditory canal and when maintaining the insertion state of the inserted ear cushion. A user may feel a specific angle to be comfortable but another user may feel the same angle to be uncomfortable. And even the same user does not prefer the same tilting angle every time he uses the earphone by inserting it into the external auditory canal. The preferred tilting angle could be different according to the condition of the day, especially the fatigability or swelling of the neck, head and/or the external auditory canal.

Therefore, it is important that the tilting angle is made so as to be adjustable.

As a conventional example, a tiltable earphone is disclosed in Korea Patent Registration No. 10-0999321 which is issued to the present applicant. The tiltable earphone disclosed in the above patent includes a speaker provided therein, an earphone body defined by the outer wall that compartments an internal space for propagating the sound generated from the speaker, and an opening that is formed at one part of the outer wall to output the sound outside. Such an earphone is characterized in that it is provided with an external auditory canal insertion portion protruded toward an external space from the opening; and an ear cushion coupled to the external auditory canal insertion portion. In the above earphone, the outer wall is made of a curved surface having a curvature of a shape narrowing as it goes toward the opening. And the external auditory canal insertion portion includes a hollow body portion which has an outer diameter smaller than the size of the inner diameter of the opening and is installed so as to be extended toward external space through the opening; and a sliding portion that blocks the gap between the outer diameter of the body portion and the inner diameter of the opening and is mounted slidably along the outer wall extended from the opening.

However, the above earphone has the following problems because the tilting of ear cushion to the earphone body is embodied by forming the opening on the outer wall of the body and mounting the sliding portion on the opening so as to be freely slidable: (1) The structural strength of the outer wall is weakened by forming the opening on the outer wall, and (2) the assembly process becomes complicated when combining the body and the sliding portion in order for the sliding portion to slide around the opening.

Meanwhile, in sound information in nature, not only the sound wave but also vibration are important information if visual information is excluded, and the brain can feel the three-dimensional sensation of the sound by sensing vibration as well as the sound wave.

But the conventional earphone is constituted in such a way that the transmission of vibration is ignored or intentionally excluded. Furthermore, if an ear cushion of soft material is mounted, transmission of vibration is thoroughly excluded, so there is a problem that it is difficult to feel the three-dimensional sensation of sound.

SUMMARY OF THE INVENTION

Accordingly, it is an object of the present invention to provide a tiltable earphone in which it is possible to form a free, soft and sure tilting angle without structurally weakening the strength of the outer case of the earphone body.

Another object of the present invention is to provide a tiltable earphone that is easy to assemble, because combination with the body may not be considered in the assembly process, since the portion for sliding is positioned outside the body.

Yet another object of the present invention is to provide a tiltable earphone which enables the brain to feel the sound more three-dimensionally by making it possible to transmit vibration generated simultaneously with the generation of sound wave as well as to reliably transmit the sound wave.

To achieve the above objects, there is provided a tiltable earphone having an ear cushion mounted on the body of the earphone to be tilted freely with respect to the body, the tiltable earphone characterized in that: the body includes an outer case enclosing a sound wave generating means, and a ball joint which is provided at an end portion of the outer case having a sound wave path that propagates the sound wave generated from the sound wave generating means out of the body and has an opening communicated with the sound wave path; and an operation holder is mounted on the outer circumference of the ball joint, wherein the operation holder includes a frictional ball seat in which at least a portion of the inner surface comes into contact with the outer circumference of the ball joint so as to combine therewith, an internal passage which is communicated with the inner space of the frictional ball seat to be opened to the outside, and a periphery for the ear cushion to come into contact from the outside.

Thus, the earphone becomes sturdier because the body and its outer portion are not structurally weakened, and productivity is improved by process simplification, because the assembly process of portion for sliding is carried out only on the outside of the body.

Preferably, an air hole for air circulating is formed in the outer case corresponding to the opposite side of the sound wave path with respect to the sound wave generating means, and the outside of the outer case is provided with a both end open type cylindrical shaped vibration cover installed by blocking so that the air circulating through the air hole collides therewith.

Thus, it becomes possible for the brain to hear a sound more three-dimensionally because the transmission of vibration generated simultaneously with the sound wave is also made possible.

Preferably, of both of the open ends of the vibration cover, a fixed end is fixed to the outer case and the vibration end is separated from the outer case.

Thus, the vibration of a vibration end is transmitted to the body through the fixed end, and then it is transmitted to the external auditory canal and the human body portions around it.

Preferably, the outer case on the side provided with the air hole is formed with a cone shape which narrows as it is farther from the sound wave generating means.

Thus, the vibration energy is amplified because the vibration wave is compressed or condensed by reflection and overlap in the cone-shaped part before it comes out of the air hole.

BRIEF DESCRIPTION OF THE DRAWINGS

The above and other objects, features and other advantages of the present invention will be more clearly understood from the following detailed description taken in conjunction with the accompanying drawings, in which.

EXPLANATION OF REFERENCE NUMERALS OF MAIN PARTS OF THE DRAWINGS

Figure 1:
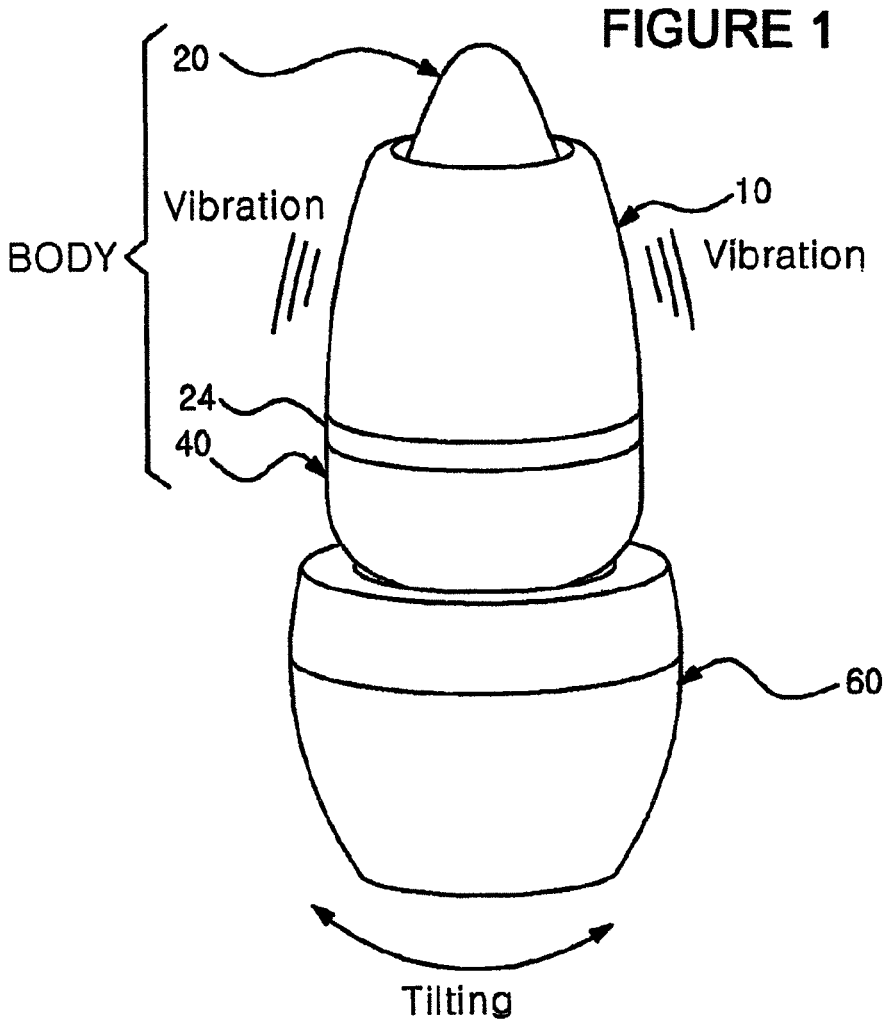
FIG. 1 is a perspective view of an earphone of the present invention.

10: Vibration cover, 11: Vibration plane, 12: Vibration end, 13: Fixed end, 19: Line hole, 20: Upper case, 22: Air hole, 23: Combination part, 24: Stepped part, 29: Line hole, 30: Bush, 32: Seat part, 33: Exit, 40: Lower case, 42: Seat part, 43: Opening, 49: Ball joint, 50: Operation holder, 51: Periphery, 52: Entrance, 53: Exit, 55: Groove, 59: Frictional ball seat, 60: Ear cushion, 62: Entrance, 63: Exit, 65: Protuberance

DETAILED DESCRIPTION OF THE INVENTION

Hereinafter, the present invention will be described in more detail with reference to specific embodiments. The same or similar components having the same functions with the same structure may be designated by the same or similar reference numerals although they are illustrated in different drawings. Thus, repeated description thereof will be omitted.

Figure 2:
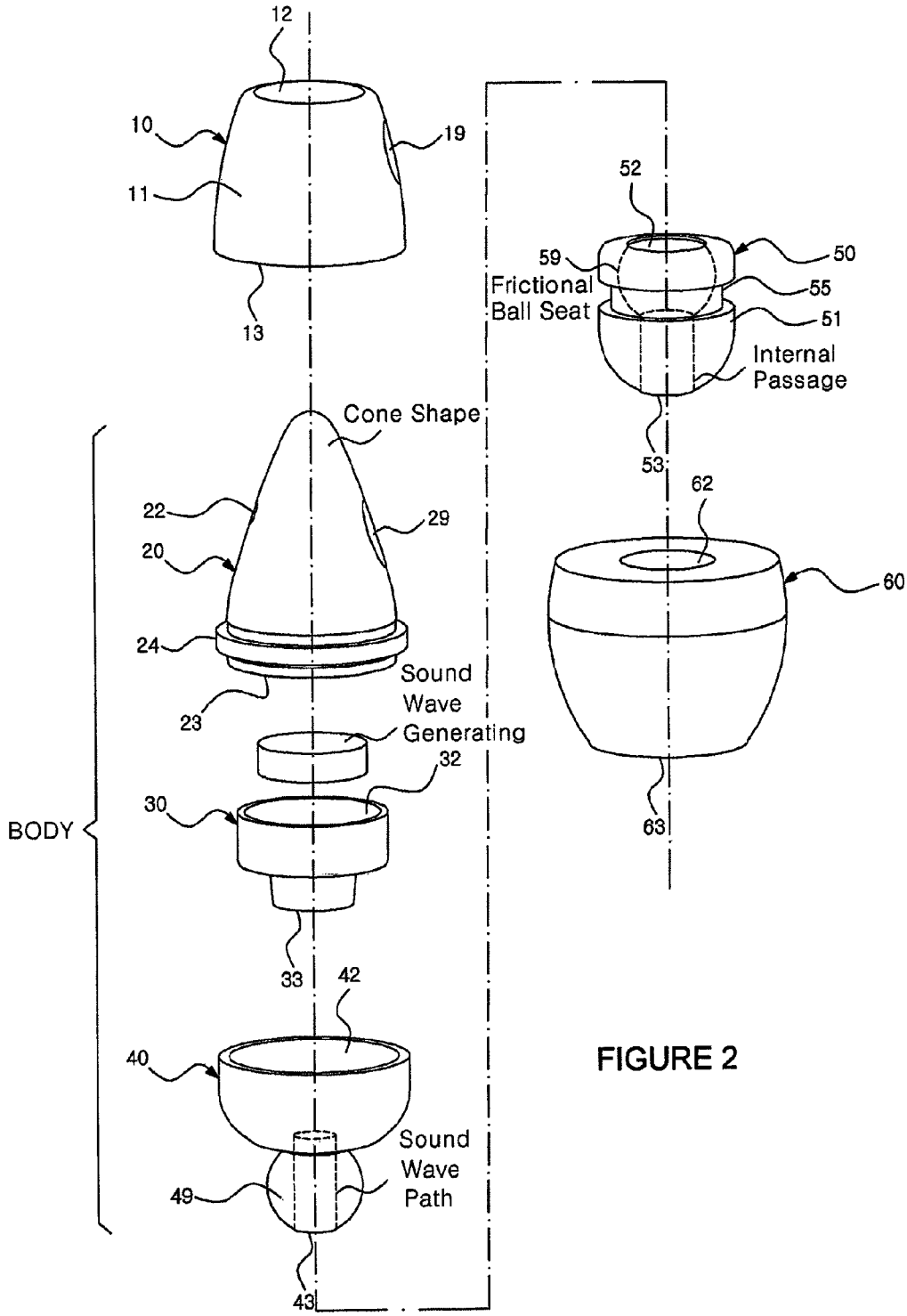
FIG. 2 is an exploded perspective view of the earphone of the present invention.
Figure 3:
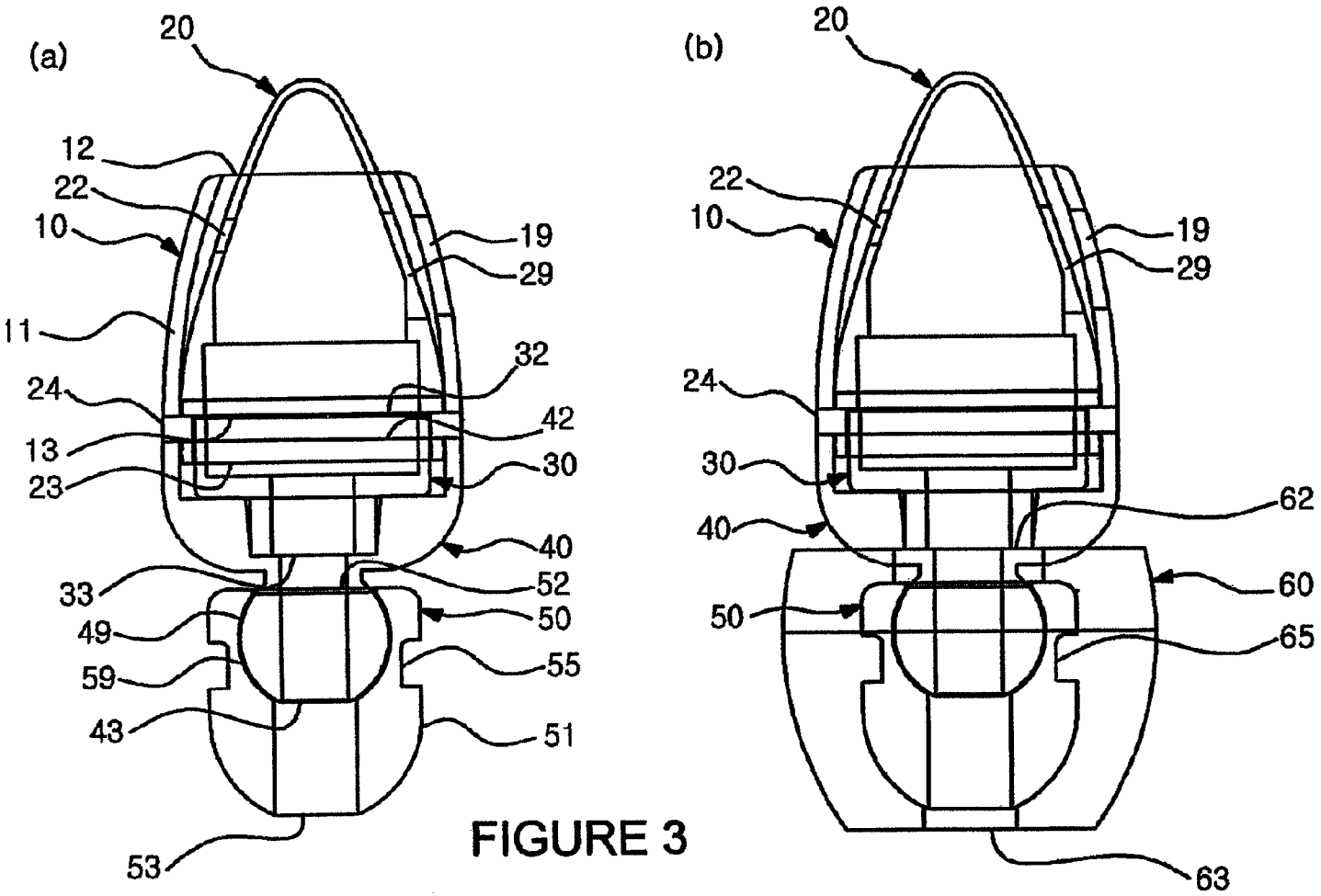
FIG. 3 is a sectional view of the earphone of the present invention, wherein (a) is a drawing with the ear cushion not mounted, and (b) is the drawing with the ear cushion mounted.
Figure 4:
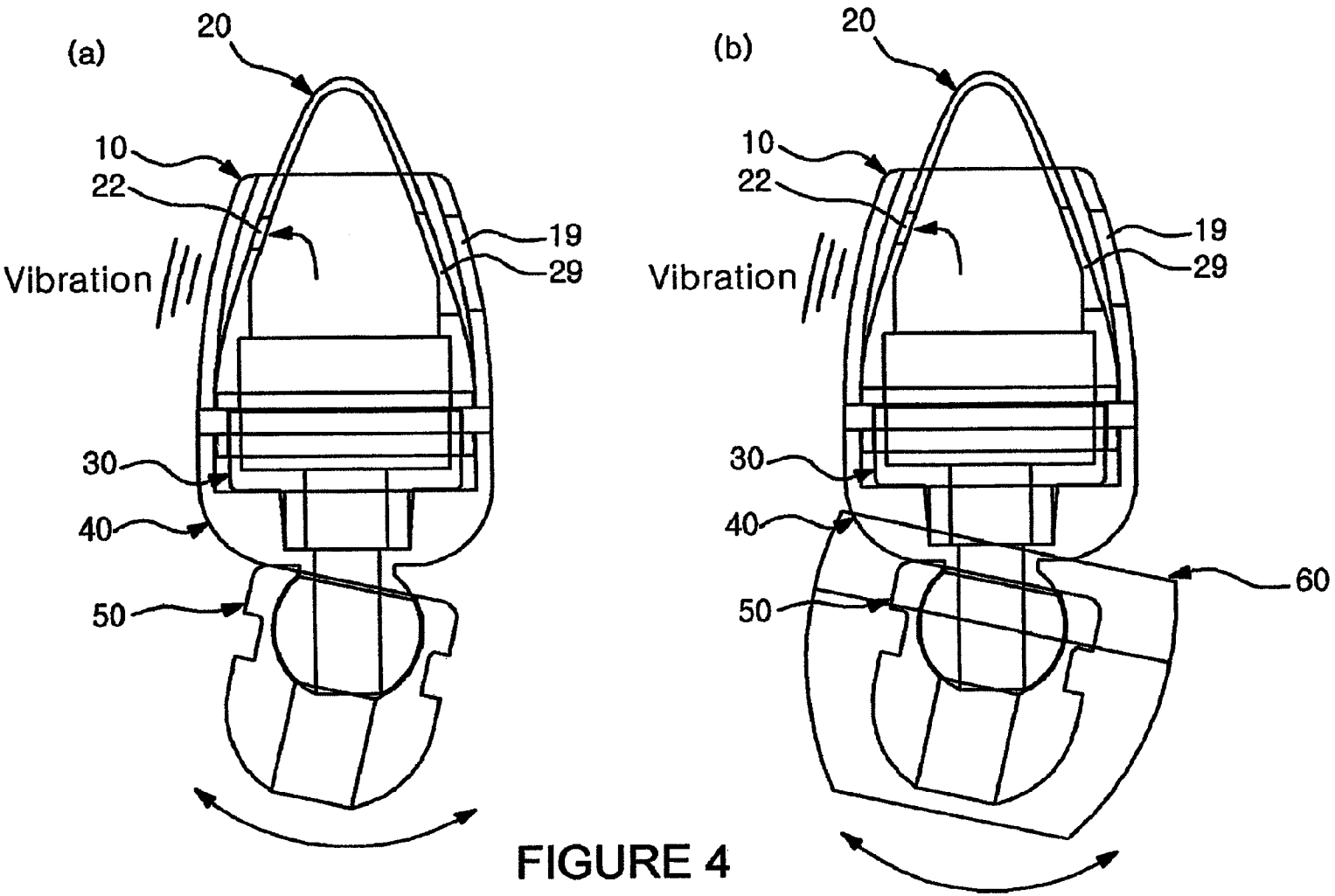
FIG. 4 is a sectional view showing a tilting operation of the earphone of the present invention, wherein (a) is a drawing with the ear cushion not mounted, and (b) is the drawing with the ear cushion mounted.

FIG. 1 is a perspective view of an earphone of the present invention, FIG. 2 is an exploded perspective view of the earphone of the present invention, FIG. 3 is a sectional view of the earphone of the present invention; wherein (a) is a drawing with the ear cushion not mounted, and (b) is the drawing with the ear cushion mounted, and FIG. 4 is a sectional view showing a tilting operation of the earphone of the present invention, wherein (a) is a drawing with the ear cushion not mounted, and (b) is the drawing with the ear cushion mounted.

As shown in FIG. 1, the present invention discloses an earphone in which an ear cushion 60 mounted on the earphone body is freely tiltable with respect to the body. The illustrated example shows the body of the earphone, which is manufactured in a form of an outer case with an upper case 20 and a lower case 40 split in two and these are combined so as to enclose the sound generating means such as a speaker. However, the present invention is not limited thereto, it could be also applied to the case in which the body is constructed in a single outer case or to the case in which it is manufactured in a plurality of three or more pieces and combined.

The body includes the outer case by the upper and lower cases 20 and 40 and a ball joint 49.

The outer case by the upper and lower cases 20 and 40 is a shell enclosing the sound generating means such as a speaker, and in the illustrative embodiment, the upper case 20 and lower case 40 make a combined body incorporated at the combination part 23. A stepped part 24 defining the combination part 23 may be formed at the lower portion of the upper case 20. The outer case by the upper and lower cases 20 and 40 is a structure for shielding the sound wave generated by the sound wave generating means and sending it to the intended direction only.

A portion of the outer case by the upper and lower cases 20 and 40 is provided with a line hole 29 through which a line for sending signals to the sound wave generating means passes. To mount the sound wave generating means, the earphone body of the illustrated example includes a bush 30 having a seat part 32 for the sound wave generating appliance and an exit 33 for the sound wave. In the drawings, the seat part 32 of the bush 30 is mounted on a seat part 42 of the lower case 40. However, the present invention is not limited thereto and the sound wave generating means may be mounted directly on the seat part 42 of the lower case 40, with the bush 30 omitted as the support function of the bush 30 is embodied in the lower case 40.

The ball joint 49, as shown in FIG. 2, is provided at a lower end portion of the earphone body, that is, a portion of the outer case. In the illustrative embodiment, a sound wave path is formed in the lower end portion of the outer case, especially the lower case 40. The sound wave path is a passage for propagating the sound wave generated from the sound wave generating means to the outside of the body. The ball joint 49 has an opening 43 communicated with the sound wave path. Through the opening 43, the sound wave comes out of the body, that is, the outer case.

An operation holder 50 is mounted on the outer circumference of the ball joint 49.

The operation holder 50 has a frictional ball seat 59, an internal passage and a periphery 51.

The frictional ball seat 59 is a space part in which at least a portion of an inner surface thereof comes into contact with the outer circumference of the ball joint 49 so as to combine therewith. The shape of the space defined by the inner surface of the frictional ball joint is not limited to spherical. Preferably, at least one portion of the inner surface, for example, protruded portions of three or more points may come into contact with the outer circumference of the frictional ball joint 49 so as to combine therewith. A preferable method of combining is combining in a tight fit against elasticity through an entrance 52 in order to secure a certain degree of constancy and predictability for relative motion by friction and sliding between the outer circumference of the ball joint 49 and the inner surface of the frictional ball seat 59, but it is not limited thereto. For example, after manufacturing the frictional ball seat 59 as two half-pieces by dividing the operation holder 50 into two, these may be assembled so as to enclose the outer circumference of the ball joint 49, and the two-divided frictional ball seats 59 may be combined by mutual fit, bolt and nuts, screws, adhesion or fusion, etc.

The internal passage is a passage connected to the frictional ball seat 59 and opened to outside, as shown in FIG. 2. The end of this internal passage is an exit 53, through which the sound wave comes out of the operation holder 50. The internal passage is communicated with the inner space of the frictional ball seat 59 to be opened to the outside.

The periphery 51 is a portion for the ear cushion 60 to be combined so as to be in contact from outside. A preferable method of combining is combining in tight fit against elasticity through an entrance 62 in order to secure combination maintainability between the periphery of the operation holder 50 and the inner surface of the ear cushion 60. But way of combining is not limited thereto. For example, if a ring-shaped groove 55 for meshing is provided on the periphery 51 of the operation holder 50, a ring-shaped protuberance 65 corresponding to this may be provided in the ear cushion 60, as shown in FIG. 3(*b*). An internal passage (not shown) is provided also inside the ear cushion 60, and its end is an exit 63, through which the sound wave comes out of the ear cushion 60 and is transmitted to the external auditory canal.

Since there is no opening in the body and its outer case by dint of the structure, it becomes sturdier with no weak structure. And the assembly process of sliding portions of the ball joint and the operation holder is carried out only on the outside of the body. Therefore, productivity is improved by process simplification as the assembly is made separately from the manufacture of the body.

Below will be described a structure for transmitting vibration as sound information besides the sound wave received by the brain.

In addition to the basic structure above, it is preferable to provide an air hole 22 and a vibration cover 10 for generation and transmission of vibration.

The air hole 22 is provided in the outer case, especially the outer case on the opposite side of the sound wave path with respect to the sound wave generating means. In the illustrative embodiment, it is provided in the upper case 20. The air hole 22 is a passage for air to circulate. Accordingly, the vibration wave that is generated incidentally when the sound wave is generated from the sound wave generating means is propagated in the internal space of the upper case 20 to come out into an external space through the air hole 22.

The vibration cover 10 is a structure installed on the outer case, that is, the outside of the upper case 20 in the illustrative embodiment. It is installed in such a fashion that the air circulating through the air hole 22 collides with and blocks the vibration plane 11 of the vibration cover 10. The vibration cover 10 has shape made roughly into a cylinder with both ends open. Accordingly, the vibration wave that has come out into an external space through the air hole 22 collides with the vibration plane 11 of the vibration cover 10 to vibrate the vibration plane 11, namely, the vibration cover 10. That is, the vibration of air is converted into the vibration of a solid. This vibration is transmitted to the external auditory canal and the human body portions around it through the outer case, namely, the upper case 20. Meanwhile, a line hole 19 is formed on a portion of the vibration cover 10.

In some cases, transmission of vibration above may be not enough because of the ear cushion 60 of soft material existing in the middle of the transmission path. However, too strong vibration could rather cause displeasure and pain. And tactual sensation can be easily sensed even with a slight vibration, and vibration that is generated and transmitted simultaneously with the sound wave imparts regularity and predictability unlike randomly generated vibration, so that it can be easily sensed by the brain.

Thus, the brain can feel the sound more three-dimensionally since above structure makes it possible to also transmit the vibration generated simultaneously with the sound wave.

In addition, for surer generation and transmission of vibration, it is preferable that of both of the open ends of the vibration cover 10, the fixed end 13 is fixed to the outer case and the vibration end 12 is separated from the outer case.

Since the fixed end 13 is fixed, it does not contribute to vibration. And the vibration end 12 makes elastic vibration based on the fixed point of the fixed end 13, so that the amplitude of the vibration cover 10 can be reinforced.

Thus, the vibration of the vibration end is transmitted to the body through the fixed end, and this is transmitted to the external auditory canal and the human body portions around it.

In order to reinforce the amplitude of the vibration wave in the internal space of the body, it is preferable that the outer case by the upper case 20 on the side provided with the air hole 22 is formed in a cone shape which narrows as it is farther from the sound wave generating means (see FIG. 2).

The vibration wave generated by the sound wave generating means is propagated along the central axis of the body, and is reflected when it arrives at the end of the internal space of the outer case by the upper case 20. Since the shape of this outer case by the upper case 20 is of a cone shape, complicated phenomena occur such as compression and condensation made by concentration of the same energy in a space narrowed together with reflection by slope and the forming of standing wave by overlap of traveling wave and reflecting wave. But all these phenomena are after all a concentration of the same energy of vibration in a narrow space, so an increase of amplitude is brought about.

Thus, the vibration wave is compressed and condensed by reflection and overlap in the cone-shaped part before it comes out of the air hole, so that vibration energy is amplified.

The present invention can be utilized in the industry of a tiltable earphone in which especially the tilting angle between the body and the ear cushion can be adjusted.

According to the present invention, a tiltable earphone with improved strength is provided because the structure of the outer case of the earphone body is not damaged at all since the earphone body and the operation part are constituted in such a way that sliding occurs outside the earphone body. Also, productivity is improved because combination with the earphone body may not be considered in the assembly process. Also, it enables the brain to feel the sound more three-dimensionally because transmission of the vibration generated simultaneously with the sound wave is also made possible.

While the present invention has been described with reference to the preferred embodiments, it will be understood by those skilled in the related art that various modifications and variations may be made therein without departing from the scope of the present invention as defined by the appended claims.

What is claimed is:

1. A tiltable earphone having an ear cushion mounted on the body of the earphone to be tilted freely with respect to the body, the tiltable earphone characterized in that:

the body includes an outer case enclosing a sound wave generating means, and a ball joint which is provided at an end portion of the outer case having a sound wave path that propagates the sound wave generated from the sound wave generating means out of the body and has an opening communicated with the sound wave path;

an operation holder is mounted on the outer circumference of the ball joint, wherein the operation holder includes a frictional ball seat in which at least a portion of the inner surface comes into contact with the outer circumference of the ball joint so as to combine therewith, an internal passage which is communicated with the inner space of the frictional ball seat to be opened to the outside, and a periphery for the ear cushion to come into contact from the outside, the ball joint and the frictional ball seat being movably interconnected along three degrees of freedom between the outer case and the operation holder;

an air hole for air circulating is formed in the outer case corresponding to the opposite side of the sound wave path with respect to the sound wave generating means; and the outside of the outer case is provided with a both end open type cylindrical shaped vibration cover installed by blocking so that the air circulating through the air hole collides therewith, wherein a fixed end of the vibration cover is fixed to the body and a vibration end of the vibration cover is separated from the body, the sound wave path is configured to propagate the sound wave toward an external auditory canal of a user, while a vibration wave for generating airflow through the air hole propagates away from external auditory canal, and vibration is generated by collision of the vibration wave onto the vibration cover which obstructs the vibration wave, and the vibration is transmitted to the body.

2. The tiltable earphone of claim 1, wherein the outer case on the side provided with the air hole is formed with a cone shape which narrows as it is farther from the sound wave generating means.

3. The tiltable earphone of claim 1, wherein the outer case on the side provided with the air hole is formed with a cone shape which narrows as it is farther from the sound wave generating means.

* * * * *